US005507458A

United States Patent [19]

Campbell et al.

[11] Patent Number: 5,507,458

[45] Date of Patent: Apr. 16, 1996

[54] HEIGHT AND TILT ADJUSTABLE WRIST REST

[75] Inventors: James K. Campbell, Sandwich; Ned C. Pfeiffer, Chicago, both of Ill.; Nicola Balderi, Bloomfield Hills; Doug G. Schaefer, Taylor, both of Mich.

[73] Assignee: Fellowes Manufacturing Company, Itasca, Ill.

[21] Appl. No.: 337,123

[22] Filed: Nov. 10, 1994

[51] Int. Cl.[6] ..... B43L 15/00

[52] U.S. Cl. ..... 248/118.3; 248/918; 400/715

[58] Field of Search ..... 248/118, 118.1, 248/118.3, 118.5, 918; 400/715

[56] References Cited

U.S. PATENT DOCUMENTS

| | | | |
|---|---|---|---|
| D. 328,892 | 8/1992 | Miller | D14/100 |
| D. 330,018 | 10/1992 | Miller | D14/100 |
| 4,481,556 | 11/1984 | Berke et al. | 248/118 X |
| 4,482,063 | 11/1984 | Berke et al. | 248/118 X |
| 4,482,064 | 11/1984 | Berke et al. | 248/118 X |
| 4,545,554 | 10/1985 | Latino et al. | 248/118.1 |
| 4,621,781 | 11/1986 | Springer | 248/118 |
| 4,688,862 | 8/1987 | Fowler et al. | 248/118.3 X |
| 4,913,390 | 4/1990 | Berke | 248/118.3 X |
| 4,973,176 | 11/1990 | Dietrich | 400/715 |
| 4,976,407 | 12/1990 | Schwartz et al. | 248/118.3 |
| 5,004,196 | 4/1991 | Gross | 248/118.3 |
| 5,040,757 | 8/1991 | Benaway | 248/118 |
| 5,050,826 | 9/1991 | Johnston | 248/118.3 |
| 5,056,743 | 10/1991 | Zwar et al. | 248/118 |
| 5,072,905 | 12/1991 | Hyatt | 248/118 |
| 5,088,668 | 2/1992 | Grimm | 248/118.3 |
| 5,125,606 | 6/1992 | Cassano et al. | 248/118 |
| 5,131,614 | 7/1992 | Garcia et al. | 248/118 |
| 5,147,090 | 9/1992 | Mandell et al. | 248/118.1 |
| 5,219,136 | 6/1993 | Hassel et al. | 220/555 X |
| 5,346,164 | 9/1994 | Allen | 248/118 |

OTHER PUBLICATIONS

Pp. 170–172 from the Fall 1992 Reliable catalog with pp. 170 and 171 (U.S.A.).

Pp. 144 and 145 from the 1992/1993 Staples catalog (U.S.A.).

Pp. 256–257, 259, 261–263 from the Nov., 1992 Quill catalog (U.S.A.).

Pp. 7 and 64–65 from a 1992 Misco catalog (U.S.A.).

P. 60 from a 1992 Curtis catalog (U.S.A.).

P. 14 from a 1992 Lyben catalog (U.S.A.).

An undated brochure for wrist supports from Wrist Air Inc. (U.S.A.).

Pp. 110–111 from a 1993 Misco catalog (U.S.A.).

Pp. 550 and 555 from a 1994 Boise Office Products catalog (U.S.A.).

Pp. 72–73 and 80–81 from a 1994 Global catalog (U.S.A.).

*Primary Examiner*—Ramon O. Ramirez

*Attorney, Agent, or Firm*—Willian Brinks Hofer Gilson & Lione

[57] ABSTRACT

A wrist rest for a keyboard, such as for computers, that can be adjusted vertically in height and in inclination independently of each other.

9 Claims, 1 Drawing Sheet

HEIGHT AND TILT ADJUSTABLE WRIST REST

BACKGROUND OF THE INVENTION

The present invention relates to a height and tilt adjustable wrist rest for a keyboard, particularly for a computer keyboard.

Generally, the keys on a keyboard are elevated from the surface on which the keyboard is placed. One problem caused by the elevation of the keys or the keyboard is that the user's wrists may be placed in a position that may cause discomfort. To alleviate the potential discomfort, a rest for the user's wrists may be provided in front of the keyboard.

Wrist rests are known and may provide an elevated structure. One problem with these wrist rests is that they are not adjustable either in the vertical direction or in inclination. Therefore, although they provide a support for the user's wrists, they may still be uncomfortable since they can not be adjusted for a particular user's comfort.

The present invention solves these problems by providing a wrist rest that can be adjusted in its height and its inclination to provide further beneficial support and comfort for the user.

SUMMARY OF THE INVENTION

The present invention provides a wrist rest for a keyboard, particularly computer keyboards. The wrist rest comprises a platform having a top surface, a bottom surface, and two ends. The ends are generally defined by a lip and are preferably convex shaped. To provide comfort to the user, a suitable padding may be provided on the top surface. A first cup extends downward from the first end and a second cup extends downward from the second end. The cups are movable with respect to the platform so that the inclination of the platform may be adjusted. Each cup also has grooves on its outer perimeter to rotatably receive a cylinder having grooves on its inner perimeter so that as the cylinder is rotated it moves up or down the cup depending on the direction of rotation. In this way, the height of the platform can be changed.

In the most preferred embodiment, the platform is molded from plastic. In this most preferred embodiment, the underside of each lip has a bolt fixed to it, preferably by molding the bolt in place. Each cup has a top that is convex shaped with a longitudinal slot through which the bolt extends. To secure the cup to the platform a nut is provided to cooperate with the bolt. It will be understood by one skilled in the art that the angle of inclination of the platform will vary because the top of the cup is convex,. As a result, the inclination of the platform can be changed independently of the height.

Although the wrist rest of the present invention is particularly useful for computer keyboards, it is to be understood that the wrist rest of the present invention can also be used with the keyboards for laptop, notebook, and subnotebook computers as well as other types of keyboards (e.g., typewriter keyboards). For ease of description and without being limited, the present invention will be described by referring to a computer keyboard.

BRIEF DESCRIPTION OF THE DRAWINGS

With reference to FIGS. 1–3 it is to be understood that the figures are not necessarily drawn to scale and are not to be interpreted as being precisely to scale.

DETAILED DESCRIPTION OF THE INVENTION AND PREFERRED EMBODIMENTS

Figure 1:
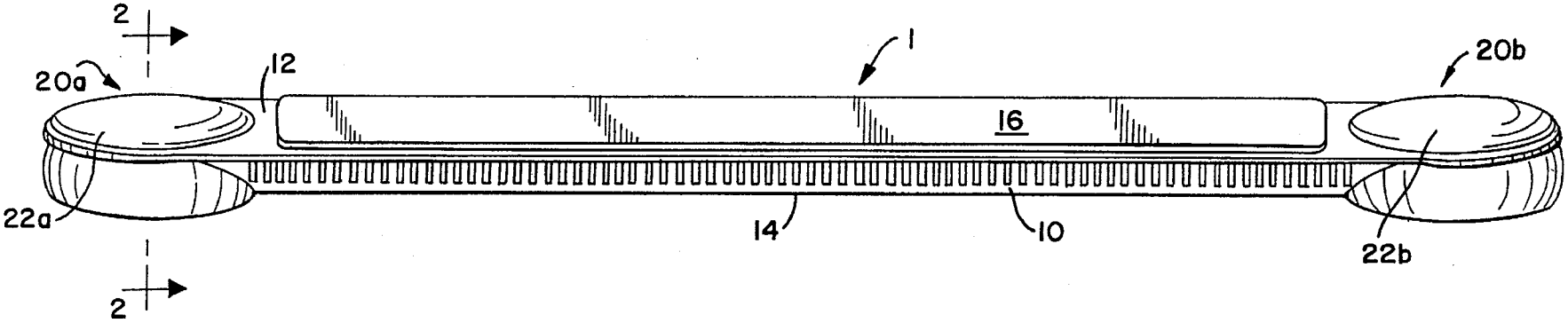
FIG. 1 is a front perspective view of the most preferred embodiment of the wrist rest.
Figure 3:
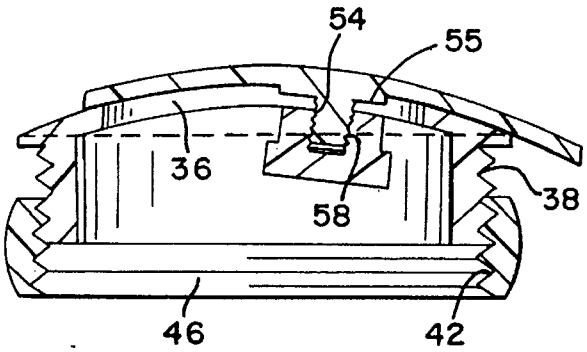
FIG. 3 is a cross-sectional view of the end the wrist rest of FIG. 1 with the platform of the wrist rest raised to a vertical height and in an inclined orientation.
Figure 2:
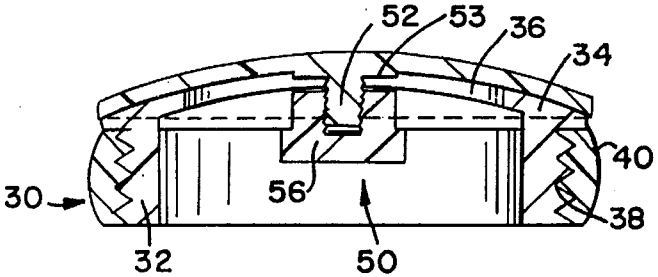
FIG. 2 is a cross-sectional view of the end the wrist rest of FIG. 1 with the platform of the wrist rest at its lowest vertical height and in a substantially horizontal orientation.

FIGS. 1–3 illustrate the wrist rest of the preferred embodiment of the invention with FIG. 1 showing a perspective view of the wrist rest 1. The wrist rest comprises a platform 10 having a top surface 12, a bottom surface 14, a first end 20*a*, and a second end 20*b*. To minimize cost and simplify manufacture, the platform is preferably molded as a single piece from plastic.

Since several different types of keyboards exist, many having a different length, it is understood that the length and width of the platform can be adjusted to provide a suitable wrist rest as dictated by, among other things, manufacturing and consumer preferences. More preferably, the length of the platform is somewhat less than the length of the keyboard. As is apparent from FIG. 1, the wrist rest is symmetrical so that the first end is the same as the second end and the front of the wrist rest is the same as the rear (assuming that the rear is that side of the wrist rest adjacent to the keyboard when the wrist rest is in use).

To provide further comfort to the user's wrists, a pad 16 may be provided on at least a portion of the top surface 12. The pad 16 may be of any resilient material suitable for cushioning the wrists and can be, if desired, reversible. For example, neoprene rubber, foams manufactured from rubber, urethane, and polyester, and the like may be used. The pad may be removable from or secured to the top surface 12 in any suitable manner by glue, adhesive, rivets, and the like. The pad may also be covered by any suitable fabric that will not chafe the user's wrists yet provide a feeling of softness and comfort.

Each end 20*a* and 20*b* is defined by a lip 22*a* and 22*b* that is rounded at its end and is convexly shaped to project above and beyond the top surface of the platform. The lips 22*a*, 22*b* cooperate with an adjusting mechanism 30 that enables the platform to be raised and lowered to various positions, as best seen in FIGS. 2 and 3. The adjusting mechanism 30 cooperates with a locking mechanism 50 that allows the platform to be rotated to various inclinations independently of the height adjustment. The adjusting mechanism is identical for each end, and therefore only one will be described.

Preferably, the adjusting mechanism 30 includes a downward extending cup 32 having a convex top 34 with a longitudinal slot 36 on its surface. In the most preferred embodiment, the cup is molded from plastic. The outer perimeter of the cup along at least a portion of its length has grooves 38, preferably extending the entire length of the cup. The cup cooperates with a rotatable cylinder 40 that has an open top and an open bottom 46. The bottom, however, may be closed if desired. In the most preferred embodiment, the cylinder is molded from plastic. The rotatable cylinder has grooves 42 along at least a portion of its length preferably extending the entire length of the cylinder. The grooves 42 threadably engage the grooves 38. In this way, when the rotatable cylinder is rotated, the rotatable cylinder changes its vertical position with respect to the cup. It will be appreciated by one skilled in the art that if the rotatable cylinders are rotated in one direction the relative vertical height of the platform from the work surface may be increased, and decreased.

The grooves 38 and 42 may be oriented so that each rotatable cylinder is lowered when it is rotated in the same direction, i.e., clockwise. Alternatively, the grooves on one fixed cylinder may be provided in one orientation so that one rotatable cylinder must be rotated in one direction, i.e., clockwise, to lower it while the other rotatable cylinder must be rotated in another, opposite direction, i.e., counterclockwise to lower it.

The bottom of the rotatable cylinder rests on the work surface and supports the platform above the work surface at a vertical height. The bottom may be provided with a non-skid material to minimize unwanted movement of the wrist rest on the work surface.

As noted above, each cup has a convex top with a slot 36 on its surface, as best seen in FIGS. 2 and 3. The slot cooperates with a locking mechanism 50 to adjust the inclination of the platform. Since the locking mechanism is identical for each end, only one will be described. The locking mechanism 50 includes a bolt 52 that extends through the slot on the cup and guide ribs 53 that prevent the cup from moving when the cylinder is rotated. Preferably, the bolt 52 is fixed to the underside of the lip. More preferably, the bolt is fixed by molding it in place with the underside of the platform especially the cup. The bolt has grooves 54 on its outer periphery that threadably cooperate with a nut 56 having grooves 58 on its inner periphery to lock the cup in a desired position. It will be appreciated by one skilled in the an that since the top surface of the fixed cylinder is convex, as the position of the cup moves relative to the bolt 52, the angle of inclination of the platform can be modified. Of course, it is to be understood that when the bolt is located at the apex of the slot of the fixed cylinders, the platform will be substantially vertical. In this way a wrist rest is provided that can be independently adjusted both vertically and in its inclination relative to a horizontal plane.

It should be understood that a wide range of changes and modifications can be made to the embodiments described above. It is therefore intended that the foregoing description illustrates rather than limits this invention, and that it is the following claims, including all equivalents, which define this invention.

We claim:

1. A wrist rest comprising:

a. a platform having a top surface, a bottom surface and two ends;

b. a first cup extending downward from the first end and having grooves on its outer perimeter;

c. a second cup extending downward from the second end and having grooves on its outer perimeter;

d. a first rotatable cylinder with an open top and having grooves on its inner perimeter to rotatably cooperate with the grooves on the first cup to vertically adjust the first end of the platform; and e. a second rotatable cylinder with an open top and having grooves on its inner perimeter to rotatably cooperate with the grooves on the second cup to vertically adjust the second end of the platform.

2. The wrist rest of claim 1 wherein the first cup has a convex top with a slot and the second cup has a convex top with a slot such that each slot cooperates with a first and a second locking mechanism, respectively, to adjust the inclination of the platform relative to a horizontal plane.

3. The wrist rest of claim 2 wherein each locking mechanism includes a bolt that is fixed to each end, extends through the slot, and is engaged by a nut.

4. A wrist rest comprising:

a. a platform having a top surface, a bottom surface and two ends;

b. a first cup extending downward from the first end and having grooves on its outer perimeter and a convex top with a slot;

c. a second cup extending downward from the second end and having grooves on its outer perimeter and a convex top with a slot;

d. a first rotatable cylinder with an open top and having grooves on its inner perimeter to rotatably cooperate with the grooves on the first cup to vertically adjust the first end of the platform;

e. a second rotatable cylinder with an open top and having grooves on its inner perimeter to rotatably cooperate with the grooves on the second cup to vertically adjust the second end of the platform; and, f. a first and a second locking mechanism that cooperates with the first and second cup, respectively, such that the inclination of the platform relative to a horizontal plane can be adjusted.

5. The wrist rest of claim 4 wherein each locking mechanism includes a bolt that is fixed to each end, extends through the slot, and is engaged by a nut.

6. The wrist rest of claim 1 further having a pad provided on at least a portion of the top surface of the platform.

7. A wrist rest comprising:

a. a platform having a top surface, a bottom surface, a first end, and a second end;

b. a first height adjusting mechanism cooperating with the first end to adjust the vertical height of the first end of the platform independently of the second end;

c. a first tilt adjusting mechanism cooperating with a locking mechanism to adjust an inclination of the first end of the platform relative to a horizontal plane independently of the second end and independently of the height adjustment of the first end:

d. a second height adjusting mechanism cooperating with the second end to adjust the vertical height of the second end of the platform independently of the first end; and, e. a second tilt adjusting mechanism cooperating with a locking mechanism to adjust an inclination of the second end of the platform relative to a horizontal plane independently of the first end and independently of the height adjustment of the second end.

8. The wrist rest of claim 7 wherein the first height adjusting mechanism includes a downward extending cup having grooves on its outer perimeter to cooperate with a first rotatable cylinder having grooves on its inner perimeter such that the first end of the platform can be vertically adjusted and wherein the second height adjusting mechanism includes a downward extending cup having grooves on its outer perimeter to cooperate with a second rotatable cylinder having grooves on its inner perimeter such that the second end of the platform can be vertically adjusted.

9. The wrist rest of claim 7 wherein the first tilt adjusting mechanism includes a first cup having a convex top with a slot that cooperates with a first locking mechanism to adjust the inclination of the first end of the platform relative to a horizontal plane and wherein the second tilt adjusting mechanism includes a second cup having a convex top with a slot that cooperates with a second locking mechanism to adjust the inclination of the second end of the platform relative to a horizontal plane.

* * * * *

UNITED STATES PATENT AND TRADEMARK OFFICE

CERTIFICATE OF CORRECTION

PATENT NO. : 5,507,458
DATED : April 16, 1996
INVENTOR(S) : James K. Campbell et al.

It is certified that error appears in the above-indentified patent and that said Letters Patent is hereby corrected as shown below:

On the Title Page, Item [56]:

In column 2, under "OTHER PUBLICATIONS", please add the following:

-- Pages 496-501 from a 1992 United Stationers catalog with pages 496-500.

Pages 79 and 559 from a 1992 Boise catalog.

Pages 6 and 7 from the October 1992 Global catalog.

Signed and Sealed this
Twenty-eighth Day of January, 1997

*Attest:*

Bruce Lehman

BRUCE LEHMAN

*Attesting Officer* *Commissioner of Patents and Trademarks*

UNITED STATES PATENT AND TRADEMARK OFFICE

CERTIFICATE OF CORRECTION

PATENT NO. : 5,507,458
DATED : April 16, 1996
INVENTOR(S) : James K. Campbell et al.

It is certified that error appears in the above-indentified patent and that said Letters Patent is hereby corrected as shown below:

On the Title Page : Item [56]

In column 2, under "OTHER PUBLICATIONS", please add the following:

-- Pages 496-501 from a 1992 United Stationers catalog with pages 496-500.

Pages 79 and 559 from a 1992 Boise catalog.

Pages 6, 7 and 73 from the October 1992 Global catalog.

An undated catalog from Precision Line Inc.

Page 98 from a 1992 DARTEK catalog.

An undated advertisement for wrist supports from the Protector.

An undated brochure for wrist supports from AliMed Inc.

An undated brochure from Ergodyne Corp. showing wrist supports.

An undated advertisement for a wrist support from Synergy +.

UNITED STATES PATENT AND TRADEMARK OFFICE

CERTIFICATE OF CORRECTION

PATENT NO. : 5,507,458

DATED : April 16, 1996

INVENTOR(S) : James K. Campbell et al.

It is certified that error appears in the above-indentified patent and that said Letters Patent is hereby corrected as shown below:

On the Title Page (cont.)

An undated brochure from Silicon Sports.

An undated advertisement for wrist supports from SIS Human Factor Technologies, Inc. --.

Signed and Sealed this

First Day of April, 1997

Attest:

Bruce Lehman

BRUCE LEHMAN

Attesting Officer

Commissioner of Patents and Trademarks